United States Patent [19]

Bevington et al.

[11] 4,122,576

[45] Oct. 31, 1978

[54] HIGH-SPEED FLOOR TREATING MACHINE

[75] Inventors: John F. Bevington, Toledo; Michael Savidge, Oregon; Paul Meeker, Toledo, all of Ohio

[73] Assignee: The National Super Service Company, Toledo, Ohio

[21] Appl. No.: 814,158

[22] Filed: Jul. 11, 1977

[51] Int. Cl.[2] ..... A47L 11/162

[52] U.S. Cl. ..... 15/49 R; 15/98; 51/177

[58] Field of Search ..... 15/49 R, 50 R, 52, 98, 15/385; 51/177

[56] References Cited

U.S. PATENT DOCUMENTS

| | | | |
|---|---|---|---|
| 1,694,738 | 12/1928 | Geary | 15/49 R |
| 2,079,946 | 5/1937 | Myers | 51/177 |
| 2,600,233 | 6/1952 | Finnell | 15/50 R |
| 2,626,412 | 1/1953 | Petersen | 15/50 R |
| 3,837,028 | 9/1974 | Bridge | 15/98 |
| 3,912,244 | 11/1975 | Warren et al. | 15/49 R |
| 4,059,863 | 11/1977 | Deuchar et al. | 51/177 |

FOREIGN PATENT DOCUMENTS

| | | | |
|---|---|---|---|
| 159,820 | 11/1954 | Australia | 15/49 R |
| 2,036,935 | 12/1970 | France | 15/49 R |

*Primary Examiner*—Edward L. Roberts

*Attorney, Agent, or Firm*—Hugh Adam Kirk

[57] ABSTRACT

A manually-operated floor polishing machine comprising a polishing pad or brush rotatable at a speed above 660 rpm, pressing against the floor with a force of less than about 25 lbs., and positioned so that one segment of the pad presses harder against the floor than the other, such as by mounting the pad's driving plate or disc so that its plane of rotation is at an angle less than about 10° to the plane of the floor. The rotating polishing pad is mounted under the driving plate which plate is driven by an electric motor. The driving plate and motor are mounted on a frame, which frame is supported by a pair of parallel wheels located so that most of the weight of the machine is supported by these wheels. This whole assembly is guided by a rearwardly extending handle attached to this frame.

29 Claims, 7 Drawing Figures

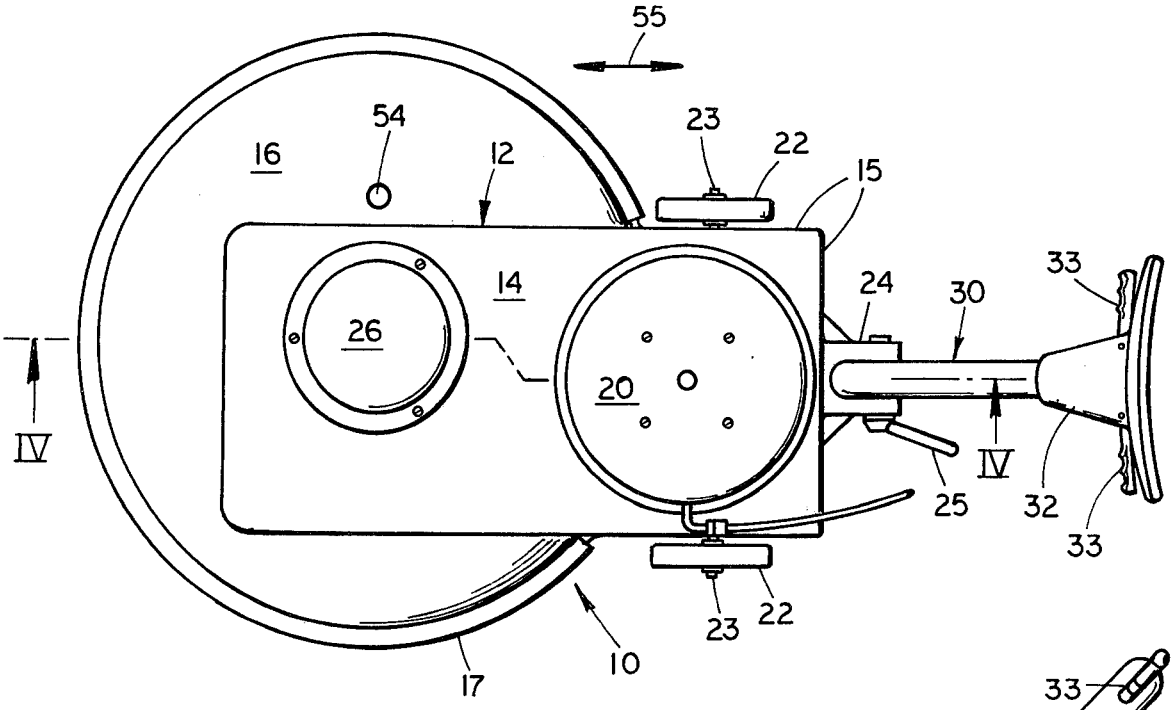
FIG. II
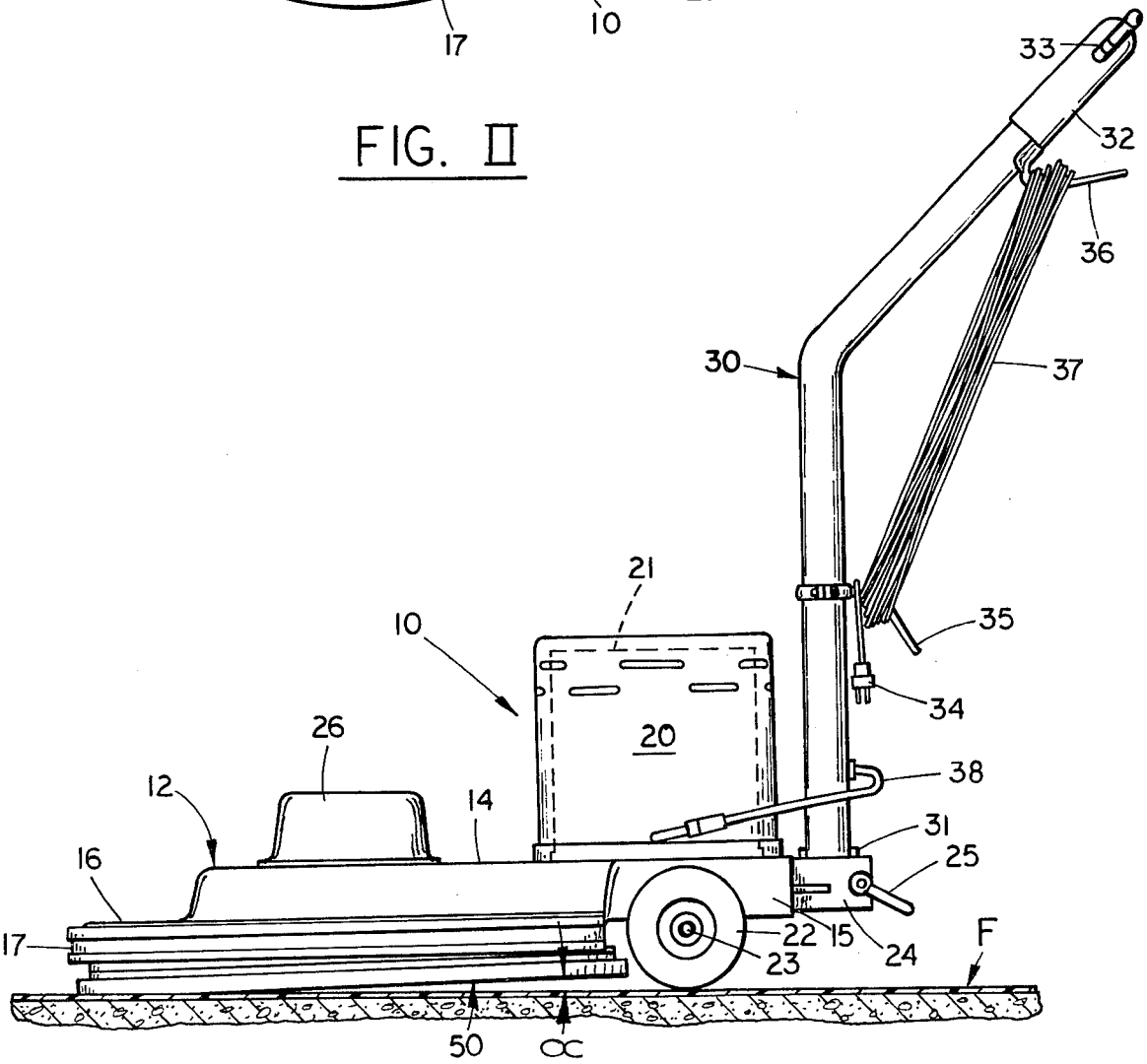
FIG. I

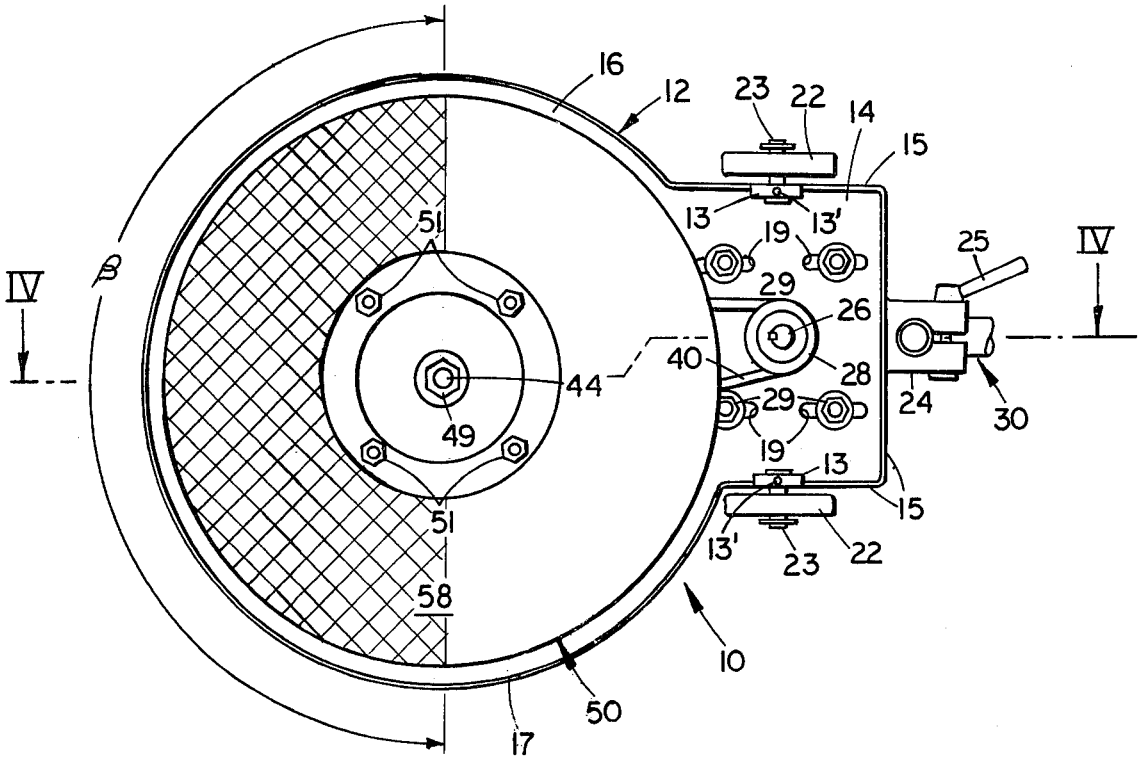
FIG. III
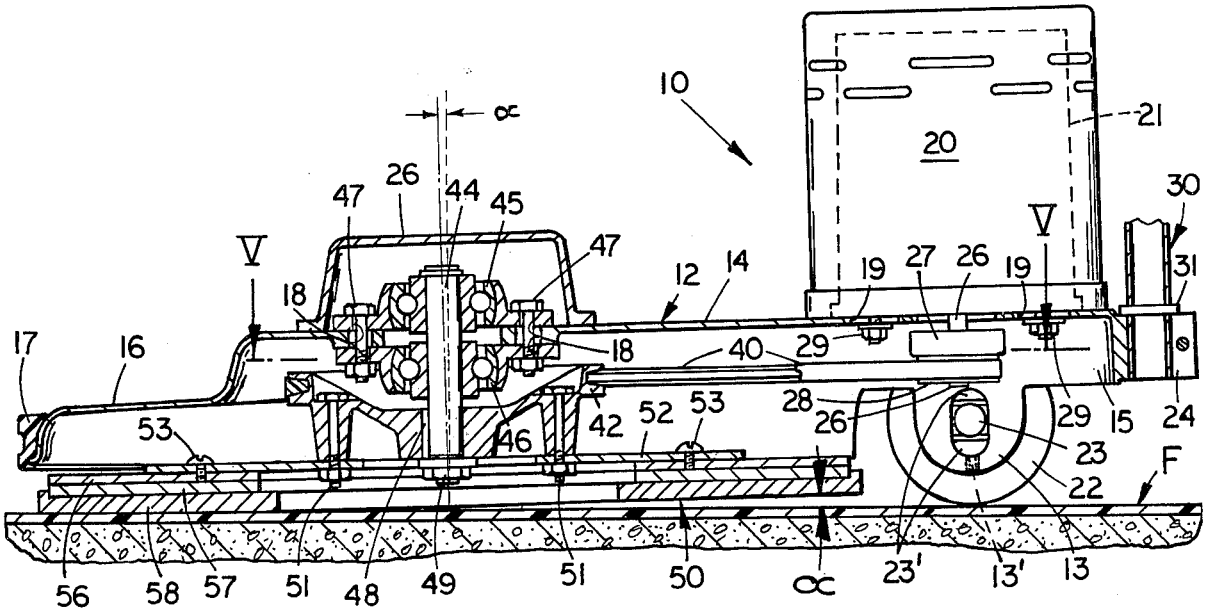
FIG. IV

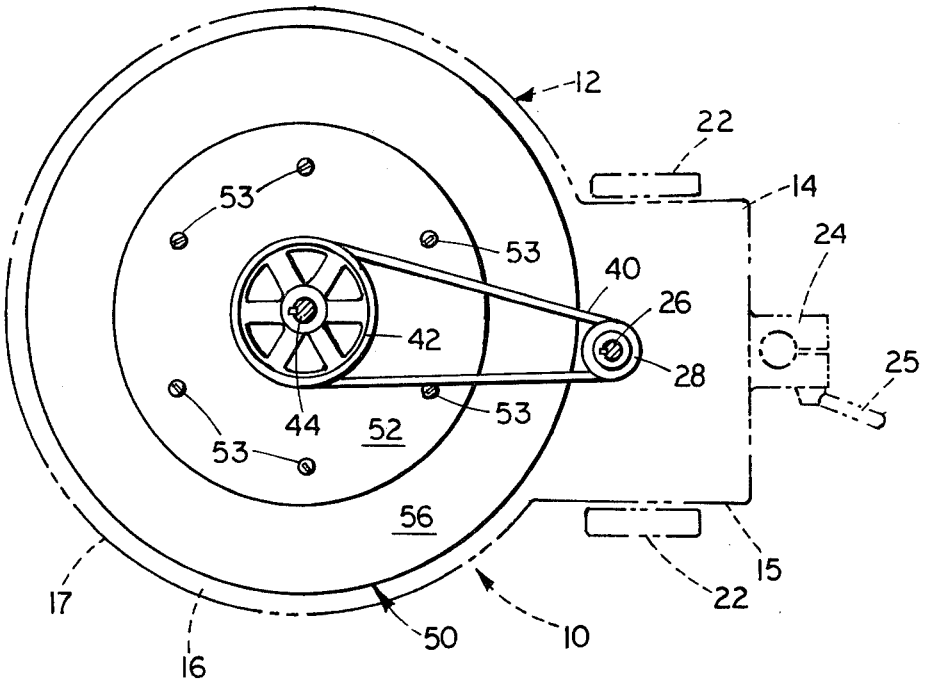
FIG. V
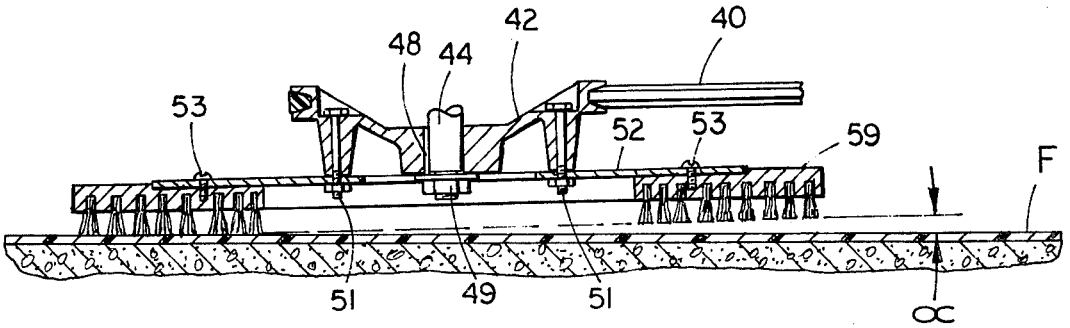
FIG. VI

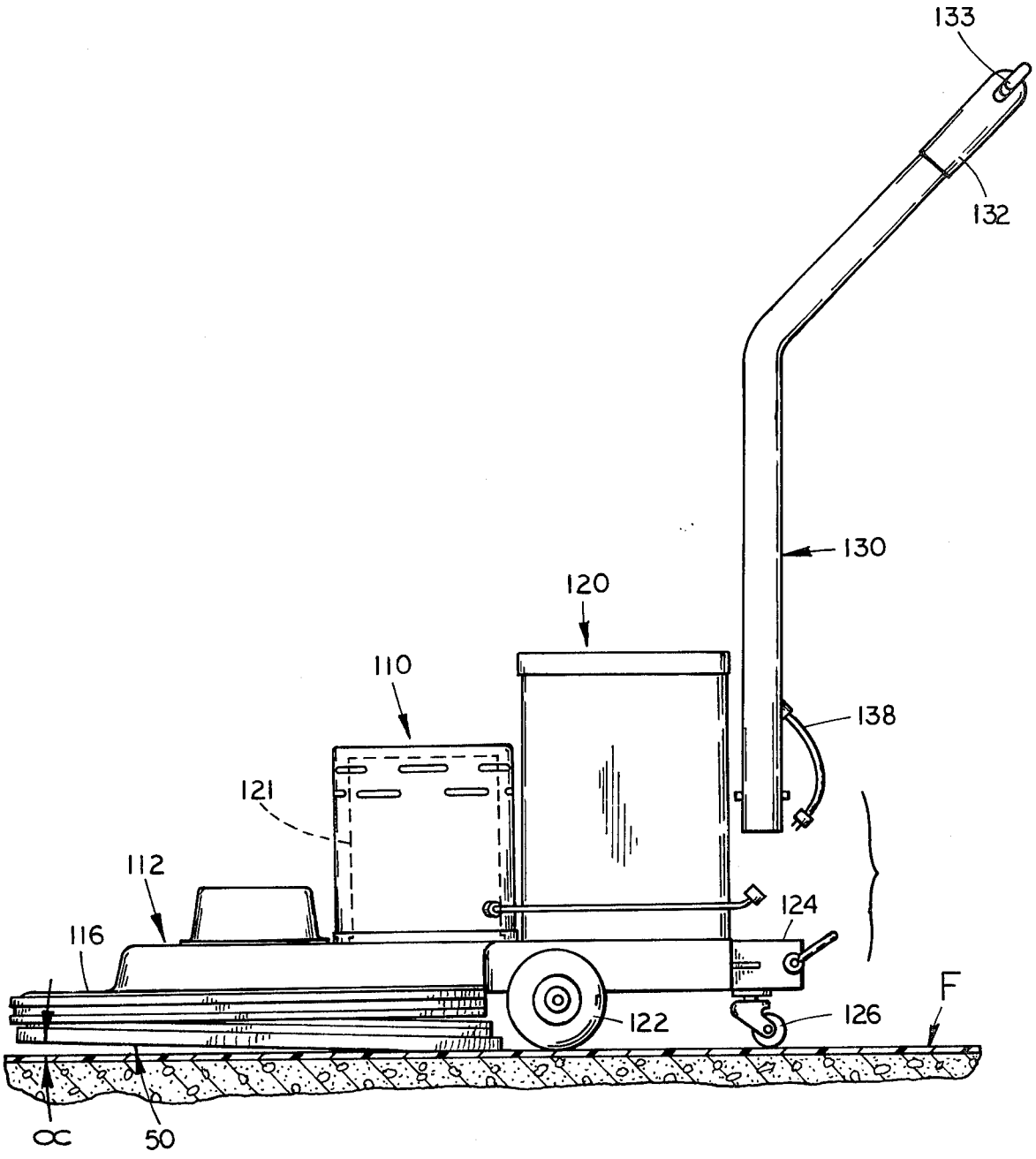
FIG. VII

HIGH-SPEED FLOOR TREATING MACHINE

BACKGROUND OF THE INVENTION

Center Weighted Machines

Previously some electric motor driven floor polishers comprising rotating horizontal discs with polishing pads thereon were rotated less than 400 rpm, and usually, at about 300 rpm. These machines were center weighted so that their polishing pads were evenly pressed against the floor so that all of the surface of said polishing pad engaged the floor. This means that the polishing pad supported the whole weight of the polisher motor and the machine, and the pressure per square inch was evenly distributed over the whole area of the pad. Thus, if the polishing pad with this weight on the pad was increased in speed beyond 400 rpm, the operator found it difficult to control the machine, particularly when the exact parallelism of the pad with the floor was changed slightly by tilting the machine and its polishing pad, which normally occurs during operation.

Furthermore, as the speed of the evenly pressed polishing pad machine with the center weight was increased beyond 400 rpm, the electric current required for its driving motor was also increased so that normal 110–120 volt AC circuits would draw more than their fuses or circuit breakers could supply; namely, more than 15 or 20 amperes. We have also found that using a larger diameter pad at a given speed, because of the increase in peripheral speed of the polishing pad and the increase in the amount of pad contacting the floor, the ampere consumption more rapidly increased to beyond the normal fusing point of 15 or 20 amperes.

Divided Weight Machines

Also previously, there have been divided weight floor machines where weight on the pad or brush was reduced by supporting some of the weight on the wheels, such as shown in the Geary U.S. Pat. No. 1,694,738 issued Dec. 11, 1928, and the Myers U.S. Pat. No. 2,079,946 issued May 11, 1937. The important feature of these two patents is the placement of the rotating pad or brush under the drive plate so that it is substantially flat or evenly pressed on the surface to be treated. If the pad speed is increased above 600 rpm on this type of machine, the reduction of the weight on the pad is not sufficient to keep the ampere consumption below 20 amperes; because all of the pad surface contacts the floor, the resistance created by friction between the pad and floor is still too great to keep the amperes drawn by the electric driving motor below 20 and preferably 15 amperes.

Accordingly, such machines would require either large electric motors with special high ampere circuit connections or would have to be powered by a 5 to 10 horsepower internal combustion engine. Such polishers are large, complicated, difficult to maintain, noisy, and difficult to operate.

SUMMARY OF THE INVENTION

Generally speaking, the high-speed floor treating and/or polishing machine of this invention comprises: (A) a housing or frame having a substantially horizontal platform upon which is mounted at least two spaced anti-friction supports such as skids, rollers, or wheels, which continuously contact the floor to support the machine; (B) a control and guiding handle extending rearwardly of the frame; (C) an electric motor for rotating a floor contacting means, which motor is mounted on the frame and which may include gearing between the motor and floor contacting means; and (D) floor contacting means rotating at a high speed including a polishing or scrubbing pad or brush, extending forwardly of the wheels on the frame.

The improvements of this invention comprise means for mounting the floor contacting means so that its plane of rotation is at an angle of not more than about 10° to the floor being treated, that the speed of rotation of the floor contacting means is greater than about 600 rpm, and that most of the weight of the machine is supported by the spaced supporting wheels for the machine.

Accordingly the source of power for rotating the floor contacting means, such as the electric motor, or the electric motor and its batteries, is mounted on the frame substantially over the spaced anti-friction supports such as wheels, so as to insure that the weight on the floor contacting means that contacts the floor is less than about 25 lbs. and preferably between about 5 lbs. and 20 lbs., and more preferably between about 7 lbs. and 15 lbs.

If an outside source is used for powering the electric motor, a relatively low ampere consumption motor is employed, such as a permanent magnet electric motor, that can receive its source of power from a normal 110–120 AC voltage circuit, have a horsepower between about ½ and 2, and under normal maximum operating conditions will not draw more than 20 amperes from the circuit, and preferably less than 15 amperes. Also, this electric motor should be able to start under load from a circuit limited by a 20 ampere circuit breaker or fusing device.

If desired, a centrifugal clutch may be provided in the driving gear between the motor and the floor contacting means to reduce starting torque. This gearing may comprise pulleys and a belt, however, other types of gearing may be employed, including various gearing if the motor has a normal speed different from the required speed for the floor contacting means.

The floor contacting means includes a polishing or scrubbing means, such as a pad, brush or the like and is normally mounted under a rotatable driving plate or disc, which plate has an attached shaft mounted to the frame or housing. This shaft may be preadjusted at an angle to the frame so that this driving plate or disc together with the floor contacting means, will have their planes of rotation preset at the same angle of less than about 10° to the floor when the machine supporting wheels and the floor contacting means are on the floor in the machine operating position. Preferably this angle is between about ½° and about 8 °, and more preferably between about 1° and 5°. One manner in which the shaft for the driving plate may be mounted to the frame or housing may comprise a pair of fixed offset self-aligning bearings spaced axially along the shaft. This angle also may be adjusted or preset by raising or lowering the supporting anti-friction means or wheels on the frame, even though the shaft for the driving plate is substantially vertical to the housing and the driving plate is substantially parallel to the housing in which it is mounted. This adjustment of the two spaced anti-friction supports or wheels may be accomplished by mounting the axles for the anti-friction supports or wheels in slots, on screws, or on levers, with shims and/or locking screws for maintaining their positions with respect to the frame. This angle varies of course depending upon the diameter of the floor contacting means or pad, the pressure of the pad onto the floor, the compressibility of the pad, the speed at which the pad is to be rotated, etc.

The floor contacting means usually is disc-shaped and has a diameter of at least about 15inches, is rotated at at least 600 rpm and preferably above about 1000 rpm, i.e., within speed ranges between 700 and 2000 rpm, and preferably between about 800 and 1500 rpm. Although the shaft for the driving plate or disc for the floor contacting means may be mounted centrally of the housing, it has been found that if it is offset slightly from the longitudinal centerline of the housing, such will aid in guiding the machine by compensating for the direction of rotation of the floor contacting means while in contact with the floor. For example, if the floor contacting means rotates in a clockwise direction when viewed from above, the offset should be to the right, and if the floor contacting means rotates in a counterclockwise direction when viewed from above, the offset should be to the left.

The guiding handle is attached to the frame, preferably near its rear so that turning of the machine may be easily accomplished as well as to directly guide the machine. This permits walking up and down along straight paths to perform the floor treating operation without having to swing the machine from side-to-side as is normally done with polishers which are center weighted.

Although the floor contacting means rotates at an angle to the floor so that only a portion thereof contacts the floor at any one time, and although the weight on this floor contacting portion is reduced to below 25 lbs., such as say about 12 lbs., the pressure per square inch of this contacting means on the floor is actually increased, resulting in improvement in floor treating and polishing results, and makes spray buffing practical. This improvement increases the aggression of the floor contacting means. Furthermore, because the whole surface of the contacting means is not evenly pressed on the floor, its drag is reduced and the ampere load on the motor is correspondingly reduced to below about 20 amperes or less, although the floor contacting means is being rotated above about 600 rpm.

OBJECTS AND ADVANTAGES

Accordingly, it is an object of this invention to produce a simple, efficient, effective, easy to manipulate, economic, high-speed floor polishing, spray buffing, and scrubbing machine that does not burn the floor.

Another object is to produce such a machine driven by an electric motor having a low ampere consumption, which can start and run in its maximum operating condition from a 110–120 volt AC electrical current source limited by a 20 ampere circuit breaker or fusing device.

Another object is to produce a high-speed floor treating machine which can be operated at a normal walking speed in a straight line and thus polish or treat a floor faster than previously known machines, materially saving time and labor expenses for the operation thereof.

Another object is to produce such a high-speed floor treating machine which can produce high gloss on a hard finished floor, be used for spray buffing to soften a floor coating to remove black marks thereon, and/or be used for dry stripping a floor coating by reducing the amount of cleaning solution previously used with low-speed floor treating machines.

Still another object is to produce such a high-speed floor treating machine which does not wobble, cannot be easily tilted forward or backward to overload the driving motor therefor, and is easy to manipulate.

BRIEF DESCRIPTION OF THE VIEWS

The above mentioned and other features, objects and advantages, and a manner of attaining them are described more specifically below by reference to embodiments of this invention shown in the accompanying drawings wherein:

FIG. I is a side elevation of one embodiment of the floor treating machine according to this invention resting on a section of a floor to be treated;

FIG.II is a top elevation of the machine shown in FIG. I;

FIG. III is a bottom view of the machine shown in FIGS. I and II as seen from the floor with the segment of the floor contacting means that presses harder on the floor being hatched;

FIG. IV is an enlarged sectional view taken along lines IV—IV of FIGS. II and III showing means for driving and angularly mounting of the floor contacting means, namely a polishing or scrubbing pad;

FIG. V is a view taken along line V—V of FIG. IV but according to the scale of FIGS. I, II and III with the machine above it shown in dot-dash lines;

FIG. VI is a partial vertical sectional view similar to FIG. IV of another type of floor contacting means, namely a brush; and FIG. VII is a side elevational view of a self-contained embodiment of this invention similar to that shown in FIG. I, but employing a battery powered electric motor, and with the control and guiding handle removed from its socket in the housing.

DETAILED DESCRIPTION OF PREFERRED EMBODIMENTS

A. The Frame

Referring first to the embodiment of this invention shown in FIGS. I through V, the high-speed floor treating machine 10 comprises a substantially horizontal platform housing or frame 12 which may comprise a substantially rectangular portion 14 having a downwardly extending peripheral flange 15. The forward part of this rectangular portion 14 may be integrally connected via the flange 15 to a circular portion 16, which may also have a peripheral downwardly extending flange 17 to provide a covering for the rotating driving plate and also may include a skirt extension (not shown) to prevent splashing by the rotating contacting means when used with a liquid.

Attached to the upper surface of the rectangular platform portion 14 at the rearward end thereof may be mounted an electric motor 21 in a housing 20. Also mounted on the top of the platform 14 may be an inverted cup-shaped cap member 26 for covering the upper exposed end of the bearings for mounting the shaft 44 for the driving plate 52. The slight tilt of the shaft 44 from the vertical, or from a perpendicular to the floor F, as shown in FIGS. II and IV, places the planes of rotation of the driving disc on plate 52 and the floor contacting means or pad 50 at an angle $\alpha$ to the floor F. This partial floor contact, or shaded area $\beta$ in FIG. III of the pad 50, reduces the normal frictional contact with the floor F, which reduces the ampere load consumption of the driving motor 21 from what it would be if the floor contacting means were completely in contact with the floor.

Beneath the motor 21 in the housing 20 and supporting most of its weight may be at least two wheels 22, herein shown to be parallel and axially aligned, journalled on stub shafts 23 anchored in vertically slotted ears 13 extending downwardly from opposite parallel longitudinal flanged sides 15 of this housing 12 as shown in FIG. III. Thus direct forward and backward movement of the machine 10 in the direction of the arrows 55 as shown in FIG. II may be accomplished easily by the operator holding the guiding handle 32. The slots in the ears 13 not filled by the stub shafts 23 are filled by different thickness shims 23' (see FIG. IV) on the same or opposite sides of the shafts 23 to raise and lower the wheels 22 with respect to the frame 12, which also is a manner for preadjusting the angle $\alpha$ of the rotating floor contacting means 50 with the floor F. These shims 23' and shaft 23 may then be held in place by a set screw 13'. Instead of the slotted ears 13 for adjusting the height and angle of the frame 12 and plane of rotation of the floor contacting means 50 with respect to the floor F, the wheels 22 may be mounted on threaded stems or lever arms as shown in the above mentioned Geary and Myers U.S. patents, respectively.

At the rear end of the housing 12, such as for example on the rear end of the platform 14 and attached to flange 15, there may be provided a C-clamp 24 with a screw clamping lever 25 for clamping the lower end of a guiding and control handle 30.

B. The Control Handle

The lower end of the guiding and control handle 30 may be provided with a cross-pin 31 which may limit both the amount of insertion of the handle into the C-clamp 24 as well as to limit its rotation in the socket of clamp 24 when clamped by the lever 25. At the other and upper end of the guiding handle 30 there may be provided a T-shaped manual grip handle 32 having a pair of oppositely extending normally open motor starting switch levers 33, either or both of which levers must be squeezed against the cross grip portion of the T-handle 32 in order to start an/or engage the motor 21 for rotating the floor contacting means 50. Intermediate the ends of the handle 30 there may be provided one or a pair of diverging wing brackets 35, or 35 and 36, between which and/or the T-part of the handle 32, an electric cable 37 may be wound for storage as shown in FIG. I when the machine 10 is not in use. One end 38 of this cable 37 may be extended through the hollow handle 30, connected through the switch of levers 33, and project from the lower end of the handle 30 for connection to the electric motor 21. The other and free end of the electric cable 37 is provided with a plug 34 which may be plugged into any standard 110–120 volt AC circuit outlet socket as is commonly employed in domestic and commercial establishments so that an extra power source from special circuit outlets is not required. Although the standard 110–120 volt AC circuit generally has its amperage limited by a 15 or 20 ampere fuse or circuit breaker, the current drawn by the motor 21 does not rupture the fuse on circuit breaker when being used even under its most strenuous operating conditions, so that the floor treating machine of this invention can be used by connection to most electric outlets.

C. The Motor and Gearing

The motor 21 in the housing 20 may be a high-speed motor, such as a 3000 rpm permanent magnet type motor, and it may be geared down by a pulley arrangement as shown in FIGS. IV and V. The driving shaft 26 of the motor 21 extends through an aperture provided therefor in the platform 14 to be connected to a driving pulley 28. This pulley 28 may be connected directly to the shaft 26, or through a centrifugal type clutch 27 in the event the motor 21 is required to get up to speed before engagement and driving the floor contacting means 50. The motor 21 may be mounted by four bolts 29 extending through slots 19 in the housing platform 14 so that longitudinal adjustment of the motor 21 may be had both for balancing of the weight of the motor on the wheels 22 and for tensioning a belt 40 for driving the floor contacting means or pad 50. This balancing of the weight of the machine 10 between the wheels 22 and the floor contacting means 50 can be preadjusted as described so that the majority of the weight of the machine 10 is on the wheels 22 and less than about 25 lbs. is supported by the rotating floor contacting means 50 that is at the angle to the floor when in operating position. Preferably the weight on the floor contacting means or pad 50 is between about 5 lbs. and 20 lbs., and more preferably between about 7 lbs. and 15 lbs.

The gearing or driving mechanism for the floor contacting means 50 herein comprises the belt 40 which drives a larger pulley 42 than its driving pulley 28, for reducing the speed of the 3000 rpm motor 21 to about 1000 rpm, or by a ratio of 3 to 1. This pulley 42 may be journalled or keyed by a key 48 to a stub shaft 44, which pulley 42 may be made integral with driving plate 52, or it may be connected to the plate 52 by bolts 51, and the assembly may be held to the shaft 44 by a nut 49. This shaft 44 may be journalled in the frame or housing 12 by a pair of axially spaced self-aligning bearings 45 and 46 along the upper end of the shaft 44, which bearings 45 and 46 are rigidly bolted to the platform 14 by means of bolts 47 which extend through slightly enlarged holes 18 in the bearing flanges and the platform 14. These enlarged holes 18 permit the vertical offsetting of these bearings 45 and 46 with respect to are slightly enlarged relative to the diameter of the bolts 47 to each other as another means for presetting the angle $\alpha$ of the plane of rotation of the driving plate 52 and conjointly the plane of rotation of the floor contacting means 50.

It is to be understood that although there is a speed reduction between the speed of the driving pulley 28 or motor 21 and that of the driving plate pulley 42, that other driving means may be employed including gears or other different speed reduction mechanisms, or the shaft 44 may be directly driven by a motor depending, upon the speed of the motor and its cantilevered weight on the floor contacting means or pad 50. The faster the floor contacting means or pad 50 rotates, the quicker and the better the finish on the floor F is cleaned, polished and hardened.

D. The Floor Contacting Means

The rotating driving plate 52 shown herein connected to the lower end of the shaft 44, may comprise a rigid or metal disc 52 to which the floor contacting means 50 may be removably attached by means of six screws 53. Access to the screws 53 may be had through the covered hole 54 in the circular platform 16 shown in FIG. II. This driving plate or disc 52 is of such a diameter that the belt 40 may be changed or a new belt installed without removal of the plate 52 from the pulley 42 or further disassembling the machine 10, in that the belt 40 can be slipped over the periphery of the disc 52 for fitting onto the pulley 42 and then around the pulley 28.

Referring more specifically to the floor contacting means 50, it herein comprises a rigid backing plate or annulus 56 into which the screws 53 are anchored (see FIG. IV). Then adhesively or otherwise fixedly attached to this backing plate 56 may be a resilient layer 57 or brush 59 to which then may be attached a buffing and/or polishing pad 58. This pad 58 may be removably attahced by friction means or a holding cup, or the like, so that this pad 58 may be replaced easily after it becomes loaded and/or worn.

This floor contacting means 50 may be replaced by an annular brush 59 as shown in the embodiment of FIG. VI which also may be attached by a bayonet type joint instead of the screws 53.

In view of the angle $\alpha$ at which the lower flat surface or plane of rotation of the floor contacting means 50 and its pad 58 or brush 59 is with the floor F, only part or a segment of the bottom surface of pad 58 or brush 59 is in contact with the floor F at any one time, such as the shaded area of the angle $\beta$ shown in FIG. III. This shaded area $\beta$ may vary between about 10% and 75%, more or less, and usually is about 40% to 60% of the pad surface.

Furthermore, this angle $\alpha$ can vary with the diameter of the rotating floor contacting means or pad 50, the pressure between the pad 50 and the floor F, the speed of the pad, the compressibility of the pad, and other factors. The outside diameter of the rotating floor contacting means or pad 50 usually is at least about 15 inches and preferably larger so as to further increase the peripheral speed of floor contacting means 50. However, smaller and larger floor contacting means may be employed, as well as two or more adjacent rotating floor contacting means or pads on one machine, without departing from the scope of this invention. However, generally, depending upon the use to be made of the machine 10, this angle $\alpha$ may be set at the factory when the machine is assembled, and need not be, and preferably is not, adjusted thereafter. This adjustment is done by vertically offsetting the bearings 45 and 46 and/or the lowering or raising of the wheels 22 shown in FIG. IV as described previously.

Although the plane of rotation of the floor contacting means 50 in FIGS. I and IV is shown to be tilted downwardly in the forward direction of the machine 10, the tilting or angle $\alpha$ may be set in the opposite direction, if desired, particularly in the case of the embodiment described below in FIG. VII.

E. A Self-Contained Machine

Referring now to the embodiment of the machine 110 shown in FIG. VII, the frame, platform or housing 112 is shown elongated to that for the machine 10 described above, in that in this instance, the power source is also on the machine, namely the batteries 120 for an electric direct current motor 121. Since the batteries 120 and the motor 121 take up more space and are much heavier than the alternating current electric motor 21, the housing 112 has been extended so that substantially all of the weight of the batteries 120 and the motor 121 are supported by the wheels 122 anchored to opposite sides of the housing 112. Also, if desired, an additional vertically adjustable balancing wheel or caster 126 may be provided at the rear of the frame 112 to help balance and support the additional weight of the self-contained power plant 120 and 121.

The drive of the polishing means 50 from the motor 121 may be by a belt means 40 or other gearing as described and shown in the previous embodiments, or the shaft of the motor 121 may have the driving plate 52 attahced directly to it.

Because of the elongation of the frame 112, the guiding handle 130 is farther away from the floor contacting means 50. Therefore, the floor contacting means with its pad or brush 50 may be angled in the opposite direction from that shown in the previous embodiments so that it contacts the floor F at its rear side instead of its front or far side, thus reducing the sideways torque to be compensated for by the operator through the handle 130. The handle 130 is provided with an electric switch operated by the hand levers 133 on the T-handle 132, which switch is connected by means of cable 138 to the motor 121. In FIG. VII, the handle 130 is shown out of its clamping socket 124 to illustrate how easily it can be removed for reducing the space for storage or shipping of either the machine 110 or 10.

If desired, the batteries 120 may be mounted on a separate cart or at a remote location and the motor 110 may be powered by an extension cord connected between the machine and the batteries, such as extension cord 37 described for the embodiment shown in FIG. 1.

F. Summary

It is this unexpected discovery whereby it is possible to rotate a polishing pad at a high speed combining a low weight pressure on the floor contacting means or pad and holding the pad at an angle to the floor that has enabled applicants to produce the present machine and to design it as described above so that it does not burn the floor, is easily controllable by the operator, and still quickly and effectively polishes, strips, and/or scrubs the floor. Furthermore, instead of moving the machine from side to side as usually is done with some prior art center weighted machines, applicants' machine may be walked forward and backward so that larger areas can be covered in less time with maximum treating, cleaning, buffing and/or polishing results.

Furthermore, in view of the angle of the rotating floor contacting means or pad 50 with respect to the surface of the floor F and the location of the wheels 22 or 122, the machine 10 or 110 is difficult to stall or overload. Since the wheels 22 or 122 are independently mounted, the machine 10 or 110 can be turned and manipulated easily for getting around corners; and because of the offset of the housing 16 and 116 shown in FIGS. II, III, and VII, these machines 10 and 110 can also be used for getting under overhanging objects.

Therefore, we have found the solution to rotating a floor contacting means at speeds above 600 rpm and still obtain the desired rapid floor treating using an electric motor but still not consuming more than about 15 or 20 amperes is as follows: (1) Divided the weight between the rotating floor contacting means and wheels but support most of the weight on the wheels; and (2) Angle the driving plate for the rotating floor contacting means so that its plane of rotation in relation to the floor is such that the floor contacting surface of this rotating means does not have all of its surface on the floor at one time. This combination of weight reduction, limiting the area of the floor contacting means on the floor, and the high speed rotation of the floor contacting means, maintains the advantage of the floor treating action above about 600 rpm, and also at the same time maintains the electrical ampere load to below about 20 amperes or less during operation so that the machine of this invention is practical for use by connection to most common electrical outlets.

While there is described above the principles of this invention in connection with specific apparatus, it is to be clearly understood that this description is made only by way of example and not as a limitation to the scope of this invention .

We claim;:

1. In a floor treating machine comprising:

A. a frame,

B. a guiding and control handle attached to said frame,

C. a supporting means of said frame,

D. an electric motor mounted on said frame,

E. a driving means rotated by said motor and mounted on said frame forwardly of said supporting means, and F. a floor contacting means releasably attached to the floor side of said driving means, the improvement comprising:

G. means for rotating said floor contacting means at a speed greater than about 600 rpm, H. means whereby the angle of the plane of rotation of said floor contacting means is preset to be less than about 10° to the plane of the floor being treated, and I. means for balancing the weight of said machine on said supporting means whereby the majority of the weight of said machine is supported by said supporting means.

2. A machine according to claim 1 wherein said frame has a longitudinally centrally offset circular shaped portion for covering said polishing means.

3. A machine according to claim 1 wherein said guiding handle includes means for controlling said motor.

4. A machine according to claim 1 wherein said guiding handle includes means for releasably attaching said handle to said housing.

5. A machine according to claim 1 wherein said supporting means are vertically adjustable.

6. A machine according to claim 1 wherein said supporting means comprises two parallel and axially aligned wheels.

7. A machine according to claim 1 including a shaft for mounting said rotating floor contacting means, said shaft being journalled in a pair of axially spaced self-aligning bearings attached to said frame.

8. A machine according to claim 1 wherein said electric motor is a permanent magnet motor.

9. A machine according to claim 1 wherein said electric motor has a horsepower between about ½ and 2.

10. A machine according to claim 1 wherein said motor comprises a direct current motor and includes a battery mounted on said frame for supplying current for said motor.

11. A machine according to claim 1 wherein said floor contacting means is rotated between about 700 and 2000 rpm.

12. A machine according to claim 1 wherein the angle of the plane of rotation of said rotating floor contacting means to said floor is between about ½ and 8°.

13. A machine according to claim 12 wherein the angle between said plane of rotation and said floor is between about 1° and 5°.

14. A machine according to claim 1 wherein said rotating floor contacting means comprises an annular shaped brush.

15. A machine according to claim 1 wherein said rotating floor contacting means comprises a compressible pad.

16. A machine according to claim 1 including a centrifugal clutch between said motor and said rotating floor contacting means.

17. A machine according to claim 1 wherein said frame includes a housing having a substantially horizontal platform.

18. A machine according to claim 17 wherein said driving means is mounted under said platform.

19. A machine according to claim 17 wherein said handle is attached near the rear of said platform.

20. A machine according to claim 17 wherein said housing is provided with a covered aperture for readily demounting said floor contacting means.

21. A machine according to claim 1 wherein said motor when connectible to a 110–120 volt AC source starts and operates from said source limited by about a 20 ampere circuit breaking device.

22. A machine according to claim 21 wherein said source is limited by about 15 amperes.

23. A machine according to claim 1 including a belt and pulleys between said plate by said motor for rotating said floor contacting means.

24. A machine according to claim 1 wherein said floor contacting means is rotated at a speed of between about 800 and 1500 rpm.

25. A machine according to claim 1 wherein the pressure on said rotating floor-contacting means is less than about 25 pounds.

26. A machine according to claim 25 wherein the pressure of said floor contacting means on the floor is between about 5 lbs. and 20 lbs.

27. A machine according to claim 26 wherein said pressure of said floor contacting means is between about 7 lbs. and 15 lbs.

28. A machine according to claim 1 wherein the axis of said motor is substantially over the axis of said supporting means.

29. A machine according to claim 1 wherein said driving means comprises a plate.

* * * * *

UNITED STATES PATENT AND TRADEMARK OFFICE

CERTIFICATE OF CORRECTION

PATENT NO. : 4,122,576

DATED : October 31, 1978

INVENTOR(S) : John F. Bevington et al

It is certified that error appears in the above-identified patent and that said Letters Patent are hereby corrected as shown below:

In the Abstract, Page 1, line 3, change "660" to - - 600 - - . Column 4, line 63, change "on" to - - or - -. Column 5, line 64, change "on" to - - or - - . Column 6, line 43, after "18" insert - - are slightly enlarged relative to the diameter of the bolts 47 to - -; line 44, cancel "are slightly enlarged"; line 45, cancel "relative to the diameter of the bolts 47 to". Column 7, line 14, change "attahced" to - - attached - -. Column 8, line 9, change "attahced" to - - attached - - ; line 60, change "Divided" to - - Divide - -. Column 9, line 18, change "of" to - - for - -. Column 10, line 34, after "operates" insert - - said machine - -

Signed and Sealed this

*Third* Day of *April 1979*

[SEAL]

*Attest:*

RUTH C. MASON
*Attesting Officer*

DONALD W. BANNER
*Commissioner of Patents and Trademarks*